US007999837B2

(12) United States Patent
Tsujino et al.

(10) Patent No.: US 7,999,837 B2
(45) Date of Patent: Aug. 16, 2011

(54) EXPOSURE HEAD, IMAGE FORMING APPARATUS, AND IMAGE FORMING METHOD

(75) Inventors: Kiyoshi Tsujino, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 28 days.

(21) Appl. No.: 12/630,618

(22) Filed: Dec. 3, 2009

(65) Prior Publication Data

US 2010/0194841 A1 Aug. 5, 2010

(30) Foreign Application Priority Data

Jan. 30, 2009 (JP) ..... 2009-019672

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/229, 347/234, 235, 238, 248–250
See application file for complete search history.

(56) References Cited

U.S. PATENT DOCUMENTS

| | | | | |
|---|---|---|---|---|
| 6,323,890 | B1 * | 11/2001 | Muto et al. | 347/237 |
| 7,425,971 | B2 * | 9/2008 | Yamazaki et al. | 347/132 |
| 2005/0094691 | A1 | 5/2005 | Yamazaki et al. | 372/38.03 |
| 2010/0172665 | A1 * | 7/2010 | Nomura | 399/51 |

FOREIGN PATENT DOCUMENTS

JP 2005-096259 4/2005

* cited by examiner

*Primary Examiner* — Hai C Pham
(74) *Attorney, Agent, or Firm* — DLA Piper LLP (US)

(57) ABSTRACT

Provided is an image forming apparatus including: a latent image carrier, on which a latent image is formed; an exposure head that includes a first light-emitting element and a second light-emitting element that is disposed in a direction in which the latent image container corresponding to the first light-emitting element is moved; and a control unit that changes over and performs a first latent image forming operation, in which the latent image is formed on the latent image container by using the first light-emitting element, and a second latent image forming operation, in which the latent image is formed on the latent image container by using the second light-emitting element, wherein the control unit controls a first light emission timing of the first light-emitting element in the first latent image forming operation and a second light emission timing of the second light-emitting element in the second latent image forming operation to be different from each other.

4 Claims, 8 Drawing Sheets

EXPOSURE HEAD, IMAGE FORMING APPARATUS, AND IMAGE FORMING METHOD

BACKGROUND

1. Technical Field

The invention relates to an exposure head that exposes a to-be-exposed surface such as a latent image carrier, an image forming apparatus using the exposure head, and an image forming method.

2. Related Art

In the related art, there are disclosed exposure heads, in which an image forming optical system forms an image by using light from a plurality of light-emitting element light-emitting elements so as to expose a surface (to-be-exposed surface) of a latent image carrier. For example, in an exposure head disclosed in JP-A-2005-096259, a plurality of light-emitting elements are aligned in a main scan direction, and an image forming optical system form an image by using light from the light-emitting elements, so that spots are formed. Therefore, a plurality of the spots are formed to be aligned in the main scan direction, and a surface of a latent image carrier is exposed by the spots, so that a one-line latent image is formed in the main scan direction. In addition, the light-emitting elements repetitively emit light at timings according to movement of the surface of the latent image container in a sub scan direction perpendicular to the main scan direction, so that a plurality of the aforementioned one-line latent images are formed in the sub scan direction. As a result, a one-page latent image is formed.

As the light-emitting element, a LED (Light Emitting Diode) device or an organic EL (Electro-Luminescence) device may be used. However, these devices are worn out due to many times of light emitting, so that the devices may not emit a sufficient light amount to form the latent image. In the exposure head disclosed in JP-A-2005-096259, a plurality of light-emitting elements are further disposed to correspond to the aforementioned plurality of light-emitting elements in one-to-one correspondence. In other words, two or more light-emitting elements are disposed to be aligned in the sub scan direction, and one of the light-emitting elements is selectively used for the exposing operation. In addition, when the selected one of the light-emitting elements is exhausted, the light-emitting element used for the exposing operation is changed over. Accordingly, the life cycle of the exposure head can be prolonged.

The two or more light-emitting elements that are aligned in the sub scan direction form spots at different positions in the sub scan direction. Accordingly, before and after the changeovers of the light-emitting elements, the forming positions of the spots are changed. As a result, before and after the changeovers of the light-emitting elements, a shift in the latent image forming position on the surface of the latent image container occurs in the sub scan direction, so that a good latent image may not be formed.

SUMMARY

An advantage of some aspects of the invention is to provide a technique of forming a good latent image by suppressing a shift in a latent image forming position before and after changeover of light-emitting elements in an exposure head that form the latent image by selectively changing over a plurality of the light-emitting elements that are disposed in a sub scan direction.

According to an aspect of the invention, there is provided an image forming apparatus including: a latent image carrier, on which a latent image is formed; an exposure head that includes a first light-emitting element and a second light-emitting element that is disposed in a direction in which the latent image container corresponding to the first light-emitting element is moved; and a control unit that changes over and performs a first latent image forming operation, in which the latent image is formed on the latent image container by using the first light-emitting element, and a second latent image forming operation, in which the latent image is formed on the latent image container by using the second light-emitting element, wherein the control unit controls a first light emission timing of the first light-emitting element in the first latent image forming operation and a second light emission timing of the second light-emitting element in the second latent image forming operation to be different from each other.

In the configuration of the invention, the control unit that changes over and performs the first latent image forming operation, in which the latent image is formed on the latent image container by using the first light-emitting element, and the second latent image forming operation, in which the latent image is formed on the latent image container by using the second light-emitting element. Accordingly, before and after the changeover between the first latent image forming operation and the second latent image forming operation, the aforementioned shift in the latent image forming position may occur. However, in the invention, the first light emission timing of the first light-emitting element in the first latent image forming operation and the second light emission timing of the second light-emitting element in the second latent image forming operation are configured to be different from each other. Accordingly, the shift in the latent image forming position is suppressed, so that a good latent image can be formed.

As described above, the shift in the latent image forming position is caused by the difference between the position of the latent image spot formed by the first light-emitting element and the position of the latent image spot formed by the second light-emitting element. In the configuration of the invention, the control unit may control the second light emission timing to be different from the first light emission timing according to a distance between a latent image spot formed by the first light-emitting element and a latent image spot formed by the second light-emitting element. Therefore, the shift in the latent image forming position is surely suppressed, so that a better latent image can be formed.

In addition, the latent image forming position of the latent image container also influence a movement speed of the latent image container as well as the light emission timing of the first light-emitting element or the second light-emitting element. In the configuration of the invention, the control unit may control the second light emission timing to be different from the first light emission timing according to the movement speed of the latent image container. Therefore, the shift in the latent image forming position is surely suppressed, so that a better latent image can be formed.

In addition, in the configuration of the invention, the image forming apparatus may further include a light emission time measuring unit that measures an accumulated light emission time of the first light-emitting element, wherein the control unit performs changeover from the first latent image forming operation to the second latent image forming operation based on a measurement result of the light emission time measuring unit. According to the configuration, when the first light-emitting element is exhausted, the changeover from the first latent image forming operation to the second latent image forming operation can be securely performed.

In addition, in the configuration of the invention, the image forming apparatus may further include: a developing unit that develops the latent image formed on the latent image container; a transferring unit that transfers the image developed by the developing unit to a recording medium; a transporting unit that transports the recording medium; a sheet number measuring unit that measures a sheet number of recording medium transported by the transporting unit; wherein the control unit calculates the sheet number of the recording medium, to which the developed image of the latent image formed by the first latent image forming operation is transferred, based on a measurement result of the sheet number measuring unit and performs the changeover from the first latent image forming operation to the second latent image forming operation based on the calculated sheet number. According to the configuration, when the first light-emitting element is exhausted, the changeover from the first latent image forming operation to the second latent image forming operation can be securely performed.

According to another aspect of the invention, there is provided an image forming method including: forming a latent image on a latent image carrier by using a first light-emitting element; changing over to a second light-emitting element that is disposed in a direction in which the latent image container corresponding to the first light-emitting element is moved; and forming a latent image on the latent image container by using the second light-emitting element by emitting light at a light emission timing different from a light emission timing of the first light-emitting element.

According to the configuration, the first light emission timing of the first light-emitting element is configured to be different from the second light emission timing of the second light-emitting element. Accordingly, the shift in the latent image forming position is suppressed, so that a good latent image can be formed.

According to another aspect of the invention, there is provided an exposure head comprising: a first light-emitting element; a second light-emitting element that is disposed in a direction in which a to-be-exposed surface corresponding to the first light-emitting element is moved; a control unit that changes over and perform a first latent image forming operation, in which the to-be-exposed surface is exposed by using the first light-emitting element, and a second latent image forming operation, in which the to-be-exposed surface is exposed by using the second light-emitting element, wherein the control unit controls a first light emission timing of the first light-emitting element in the first latent image forming operation and a second light emission timing of the second light-emitting element in the second latent image forming operation to be different from each other.

According to the configuration, the first light emission timing of the first light-emitting element in the first latent image forming operation is configured to be different from the second light emission timing of the second light-emitting element in the second latent image forming operation. Accordingly, the shift in the latent image forming position on the to-be-exposed surface is suppressed, so that a good latent image can be formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
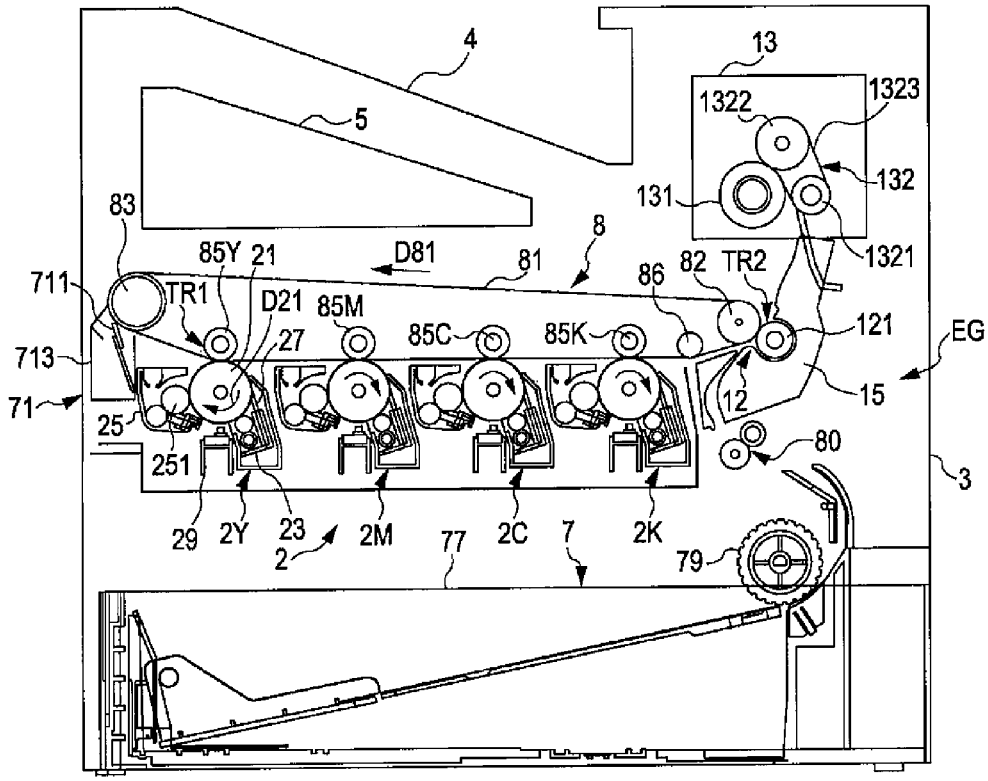
FIG. 1 is a view showing an image forming apparatus according to an embodiment of the invention.
Figure 2:
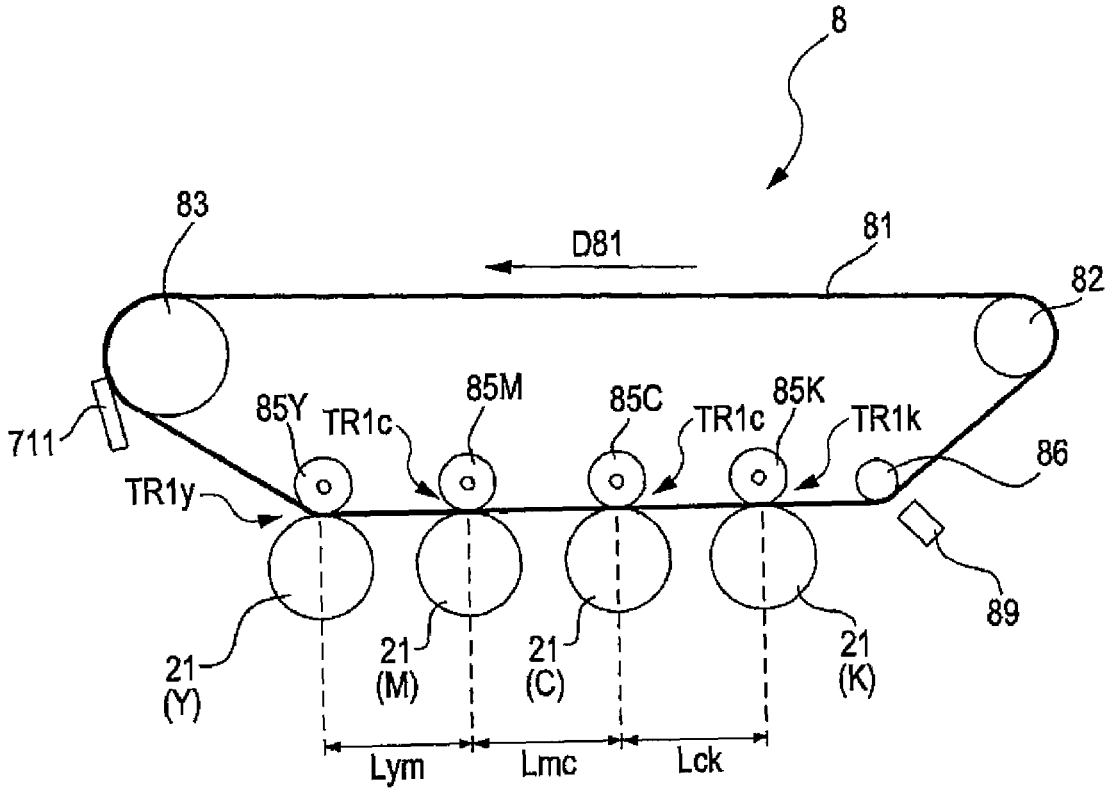
FIG. 2 is a view showing an arrangement of image forming stations in the image forming apparatus of FIG. 1.
Figure 3:
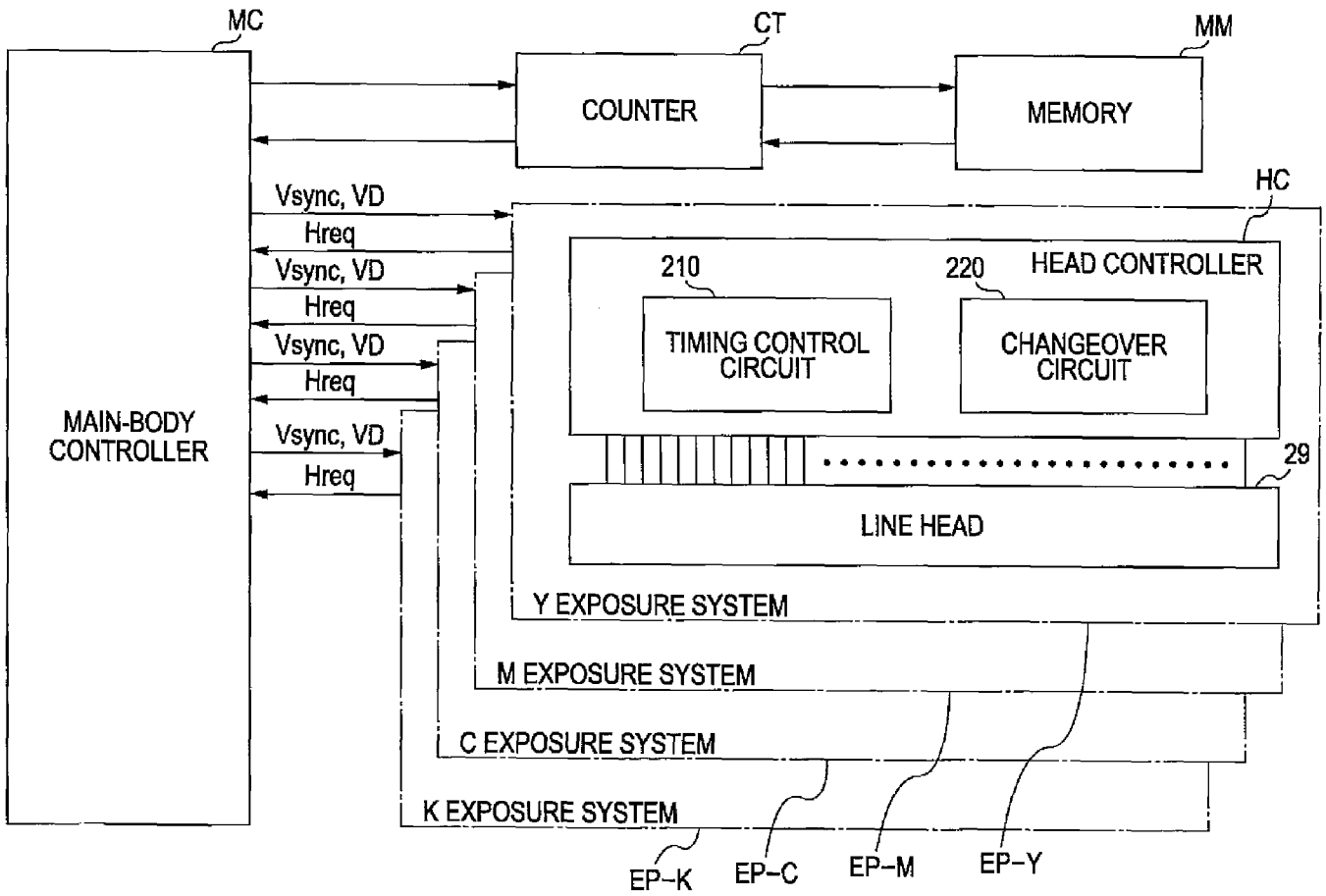
FIG. 3 is a view showing an electrical configuration of the image forming apparatus of FIG. 1.

FIG. 1 is a view showing an image forming apparatus according to an embodiment of the invention. In addition, FIG. 2 is a view showing an arrangement of image forming stations in the image forming apparatus of FIG. 1. In addition, FIG. 3 is a view showing an electrical configuration of the image forming apparatus of FIG. 1. The image forming apparatus can selectively perform a color mode, in which a color image is formed by superimposing four color toners, that is, yellow (Y), magenta (M), cyan (C), and black (K) toners, and a black-and-white mode, in which a monochromic image is formed by using only the black (K) toner. In the image forming apparatus, if an image forming command from an external apparatus such as a host computer is applied to a main-body controller MC having a CPU, a memory, and the like, the main-body controller MC controls components of the apparatus such as exposure systems EP-Y, EP-M, EP-C, and EP-K corresponding to the colors to perform predetermined image forming operations, so that an image corresponding to the image forming command is formed on a sheet that is a recording medium such as a copying paper, a transferring paper, a printing paper, and an OHP transparent sheet.

An electrical component box 5 embedded with a power supply circuit substrate, a main-body controller MC, a head controller HC, a counter CT, and a memory MM is included in a housing main body 3 of the image forming apparatus according to the embodiment. In addition, an image forming unit 2, a transfer belt unit 8, and a feeding unit 7 are also included in the housing main body 3. In addition, a secondary transferring unit 12, a fixing unit 13, a sheet guiding member 15 are disposed on the right side of the housing main body 3 of FIG. 1. In addition, the feeding unit 7 is configured to be detachably provided to the housing main body 3. In addition, the feeding unit 7 and the transfer belt unit 8 are configured so as to be individually detected for repair or replacement.

The image forming unit 2 includes four image forming stations 2Y (yellow), 2M (magenta), 2C (cyan), and 2K (black) that are to form a plurality of different color images. In addition, in FIG. 1, since the image forming stations of the image forming unit 2 have the same configuration, portions of the image forming stations are denoted by reference numerals, and reference numerals for other portions of the image forming stations are omitted for the convenience of drawing.

In each of the image forming stations 2Y, 2M, 2C, and 2K, a photoreceptor drum 21 where toner image of each color is formed on a surface thereof, is disposed. The photoreceptor drum 21 is arranged so that an axial direction thereof is parallel to a main scan direction (the direction perpendicular to the paper surface of FIG. 1). Each of the photoreceptor drums 21 is connected to a dedicated driving motor, so that the photoreceptor drum 21 is driven to rotate at a predetermined speed in a direction of the arrow D21 in the figure. Therefore, the surface of the photoreceptor drum 21 is moved in a sub scan direction perpendicular to the main scan direction. In addition, a discharging unit 23, a line head 29, a developing unit 25, and a photoreceptor cleaner 27 are disposed in the vicinity of the photoreceptor drum 21 along the rotation direction thereof. In addition, a discharging operation, a latent image forming operation, and a toner developing operation are performed by these functional units. At the time of performing a color mode, the toner images formed by all the image forming stations 2Y, 2M, 2C, and 2K are superimposed on a transferring belt 81 provided to a transfer belt unit 8 so as to form a color image. In addition, at the time of performing a black-and-white mode, a black monochromic image is formed by operating only the image forming station 2K.

The discharging unit 23 includes a discharging roller, of which surface is constructed with an elastic rubber. The discharging roller is configured to abut on a surface of the photoreceptor drum 21 at a discharging position and to be driven to rotate, so that the discharging roller is driven to rotate according to the rotation operation of the photoreceptor drum 21. In addition, the discharging roller is connected to a discharging bias generation unit (not shown), so that the discharging roller is supplied with a discharging bias from the discharging bias generation unit to charge the surface of the photoreceptor drum 21 with a predetermined surface potential at the discharging position where the discharging unit 23 is abutted on the photoreceptor drum 21.

The line head 29 is disposed to face the photoreceptor drum 21 so that the elongated direction of the line head 29 is parallel to the main scan direction. In addition, the line head 29 includes a plurality of light-emitting elements that are aligned in the elongated direction (main scan direction). In addition, light from the light-emitting elements is irradiated on the surface of the photoreceptor drum 21, which is charged by the discharging unit 23, so that an electro-static latent image is formed on the surface.

The developing unit 25 includes a developing roller 251, of which surface contains a toner. In addition, the discharging toner is moved from the developing roller 251 to the photoreceptor drum 21 by the developing bias applied to the developing roller 251 from the developing bias generation unit (not shown) electrically connected to the developing roller 251 at the developing position where the developing roller 251 is abutted on the photoreceptor drum 21, so that the electrostatic latent image formed on the photoreceptor drum 21 is developed.

The toner image developed at the developing position is transported in a rotation direction D21 of the photoreceptor drum 21, and after that, the toner image is primarily transferred to the transfer belt 81 at a primary transferring position TR1 where the later-described transfer belt 81 and each of the photoreceptor drums 21 are abutted on each other.

In addition, each of photoreceptor cleaners 27 is disposed to abut on the surface of the photoreceptor drum 21 at a downstream side of the primary transferring position TR1 in the rotation direction D21 of the photoreceptor drum 21 and at an upstream side of the discharging unit 23. The photoreceptor cleaner 27 cleans and removes toners remaining on the surface of the photoreceptor drum 21 after the primary transferring by abutting on the surface of the photoreceptor drum.

The transfer belt unit 8 includes a driving roller 82, a driven roller 83 (blade facing roller) that is disposed at the left side of the driving roller 82 in FIG. 1, and a transfer belt 81 that is suspended by the rollers and driven to circulate in a direction (transport direction) of the arrow D81 shown in the figure by the rotation of the driving roller 82. In addition, the transfer belt unit 8 includes four primary transferring rollers 85Y, 85M, 85C and 85K that are disposed on an inner side of the transfer belt 81 in one-to-one correspondence with the photoreceptor drums 21 to face the photoreceptor drums 21 having the image forming stations 2Y, 2M, 2C, and 2K at the time of mounting a cartridge. The primary transferring rollers are electrically connected to corresponding primary transferring bias generation units (not shown).

In the time of performing the color mode, as shown in FIGS. 1 and 2, all the primary transferring rollers 85Y, 85M, 85C and 85K are positioned at the sides of the image forming stations 2Y, 2M, 2C, and 2K, so that the transfer belt 81 is pressed to about on the photoreceptor drums 21 included in the image forming stations 2Y, 2M, 2C, and 2K to form the primary transferring positions TR1 between the photoreceptor drums 21 and the transfer belt 81. In addition, the primary transferring bias from the primary transferring bias generation unit is applied to the primary transferring roller 85Y or the like at a suitable timing, so that the toner images formed on the surfaces of the photoreceptor drums 21 are transferred to the surface of the transfer belt 81 at the corresponding primary transferring positions TR1. In other words, in the color mode, the one-colored toner images of the colors are superimposed on the transfer belt 81, so that the color image is formed.

In the so-called tandem type image forming apparatus, the primary transferring positions where the toner images are primarily transferred from the photoreceptor drums 21 to the transfer belt 81 are different among the image forming stations. In the embodiment, the yellow image forming station 2Y, the magenta image forming station 2M, the cyan image forming station 2C, and the black image forming station 2K are disposed in the moving direction of the transfer belt 81 in this order. Accordingly, the yellow primary transferring position TR1*y* and the magenta primary transferring position TR1*m* are separated by a distance Lym; the magenta primary transferring position TR1*m* and the cyan primary transferring position TR1*c* are separated by a distance Lmc; and the cyan primary transferring position TR1*c* and the black primary transferring position TR1*k* are separated by a distance Lck.

On the other hand, at the time of performing the black-and-white mode, the primary transferring rollers 85Y, 85M, and 85C among the four primary transferring rollers are separated from the facing image forming stations 2Y, 2M, and 2C, and only the primary transferring roller 85K corresponding to the black color is configured to abut on the image forming station 2K, so that only the black-and-white image forming station 2K can abut on the transfer belt 81. As a result, the primary transferring position TR1*k* is formed only between the primary transferring roller 85K and the image forming station 2K. In addition, the primary transferring bias from the primary transferring bias generation unit is applied to the primary transferring roller 85K at a suitable timing, so that the black toner image formed on the surface of the photoreceptor drum 21 disposed in the image forming station 2K is transferred to the surface of the transfer belt 81 at the primary transferring position TR1*k*.As a result, the monochromic image is formed.

In addition, the transfer belt unit 8 includes a downstream guide roller 86 that is disposed at a downstream side of the black primary transferring roller 85K and an upstream side of the driving roller 82. The downstream guide roller 86 is configured to abut on the transfer belt 81 in a common tangential line of the primary transferring roller 85K and the black photoreceptor drum 21 (K) at the primary transferring position TR1 where the primary transferring roller 85K abuts on the photoreceptor drum 21 in the image forming station 2K.

In addition, a sensor 89 is disposed to face a surface of the transfer belt 81 which is wound and engaged with the downstream guide roller 86. The sensor 89 is constructed with, for example, a reflection type photosensor that can optically detect a change in a reflectance of the surface of the transfer belt 81. Therefore, the sensor 89 can detect a position of a register mark or a concentration of a patch image formed on the transfer belt 81 if necessary.

The feeding unit 7 includes a feeding cassette 77 that stacks and stores sheets and a pick-up roller 79 that feeds sheets from the feeding cassette 77 sheet by sheet. After the feeding timing is adjusted by a register roller pair 80, the sheet fed from the feeding unit by the pick-up roller 79 is fed along the sheet guiding member 15 to a secondary transferring position TR2 where the driving roller 82 and a secondary transferring roller 121 are abutted on each other.

The secondary transferring roller 121 is disposed detachably with respect to the transfer belt 81, so that the secondary transferring roller 121 is driven to be detached or attached by a secondary transferring roller driving mechanism (not shown). The fixing unit 13 includes a rotatable heating roller 131 that is embedded with a heater such as a halogen heater and a pressing unit 132 that presses the heating roller 131. In addition, the sheet, where an image is secondarily transferred to the surface thereof, is guided by the sheet guiding member 15 to a nip portion that is formed by the heating roller 131 and a pressing belt 1323 of the pressing unit 132, so that the image is thermally fixed on the nip portion at a predetermined temperature. The pressing unit 132 includes two rollers 1321 and 1322 and the pressing belt 1323 that is suspended by the rollers. In addition, in the surface of the pressing belt 1323, a belt suspending surface that is suspended by the two rollers 1321 and 1322 is configured to press a circumferential surface of the heating roller 131 so that the nip portion constructed with the heating roller 131 and the pressing belt 1323 can be widened. In addition, the sheet that is subjected to the fixing process is transported to the discharge tray 4 that is disposed in an upper surface portion of the housing main body 3.

The aforementioned driving roller 82 has a function of driving the transfer belt 81 to circulate in the direction of the arrow D81 shown in the figure and a function as a backup roller for the secondary transferring roller 121. A rubber layer having a thickness of about 3 mm and a volume resistivity of 1000 kΩ·cm or less is formed in the circumferential surface of the driving roller 82, and the driving roller 82 is electrically grounded through a metallic shaft, so that a path of conducting the secondary transferring bias, which is supplied from the secondary transferring bias generation unit (not shown) through the secondary transferring roller 121, is formed. In this manner, a rubber layer having high friction and excellent impact absorption is provided to the driving roller 82, so that the deterioration in image quality caused by the impact exerted to the transfer belt 81 at the time of entering the sheet into the secondary transferring position TR2 can be prevented.

In addition, in the apparatus, a cleaner unit 71 is disposed to face the blade facing roller 83. The cleaner unit 71 includes a cleaner blade 711 and a waste toner box 713. The cleaner blade 711 is configured to allow a distal end thereof to abut on the blade facing roller 83 through the transfer belt 81, so that contaminant materials such as the toner or paper powder remaining on the transfer belt 81 after the secondary transferring can be removed. In addition, the removed contaminant materials are recovered by the waste toner box 713. In addition, the cleaner blade 711 and the waste toner box 713 are configured to be integrated with the blade facing roller 83.

In addition, in the embodiment, the photoreceptor drums 21 of the image forming stations 2Y, 2M, 2C, and 2K, the discharging unit 23, the developing unit 25, and the photoreceptor cleaner 27 are integrated into one unit as a cartridge. In addition, the cartridge is configured to be disposed detachably to the main body of the apparatus. In addition, each of the cartridges is provided with a non-volatile memory for storing information on the cartridge. In addition, the main-body controller MC wirelessly communicates with each of the cartridges. Therefore, the information on each of the cartridges is transmitted to the main-body controller MC, and the information in each of the memories is updated and stored. The usage history of each of the cartridges and the life cycle of consumable parts can be managed based on the information.

Cooperative operations of the main-body controller MC having the aforementioned configuration and the exposure systems EP-Y, EP-M, EP-C, and EP-K corresponding to the colors are described with reference to FIG. 3. If an image forming command from an external apparatus is applied to the main-body controller MC, the main-body controller MC performs a predetermined signal process on image data included in the image forming command to generate a video data VD corresponding to each toner color. At the same time, the main-body controller MC starts resetting and warming up the components of the apparatus. If the image forming operation is in an operable state by the completion of these processes, the main-body controller MC outputs a synchronization signal Vsync for starting the image forming operation to the head controller HC that controls each of the line heads 29. When the synchronization signal Vsync is received, the head controller HC sequentially outputs horizontal request signals Hreq to the main-body controller MC. In addition, every time when the horizontal request signal Hreq is received, the main-body controller MC outputs one-line video data VD in the main scan direction MD to the head controller HC, so that the head controller HC allows the light-emitting element Es in the line head 29 to emit light based on the received video data VD. At this time, the light emission timing of the light-emitting element is controlled by the timing control circuit 210, which is described later in detail.

Figure 4:
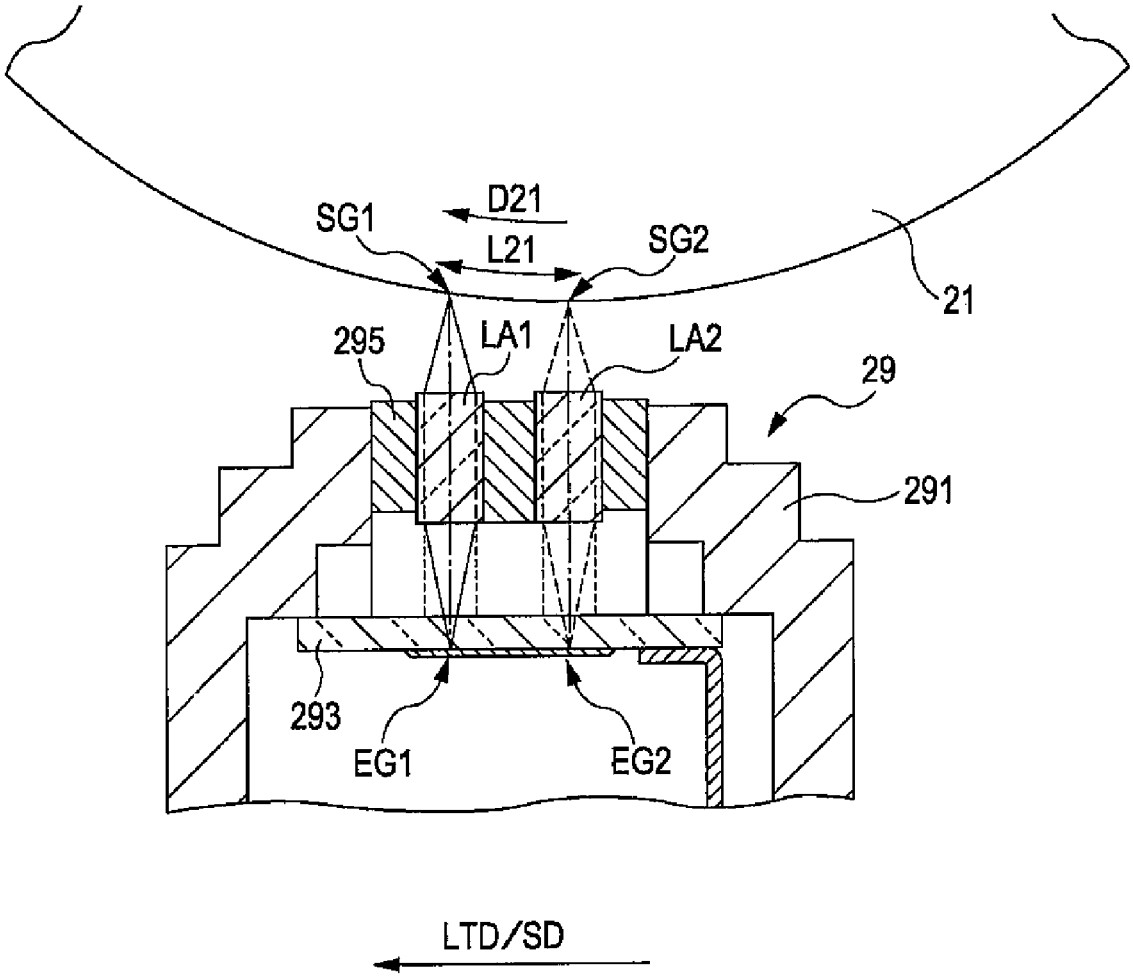
FIG. 4 is a partial cross-sectional view showing a line head in a width direction.
Figure 5:
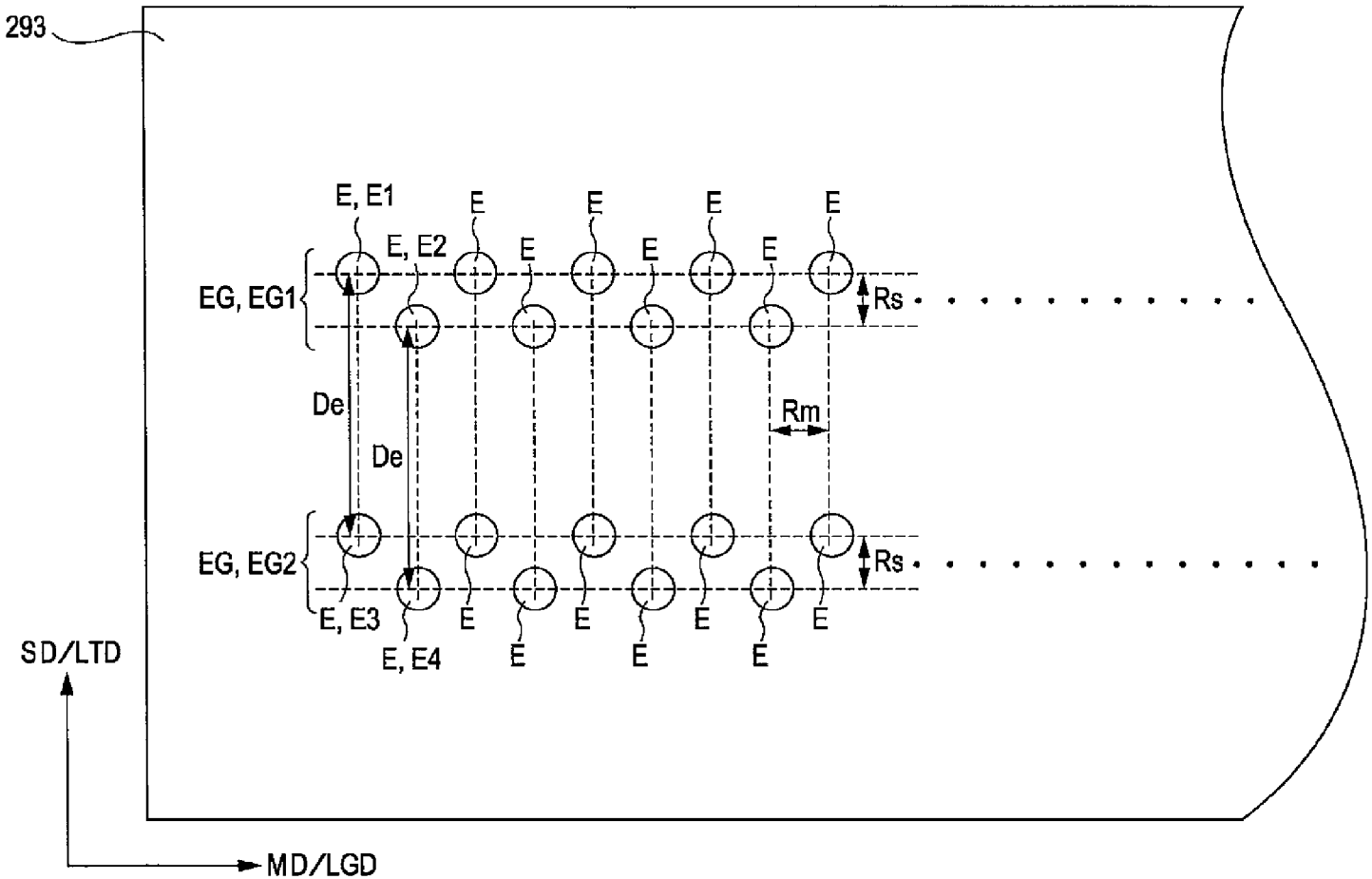
FIG. 5 is a plan view showing an arrangement of light-emitting elements included in the line head.

FIG. 4 is a partial cross-sectional view showing the line head in the width direction. In addition, FIG. 5 is a plan view showing an arrangement of light-emitting elements included in the line head, in which the rear surface of the later-described head substrate 293 is perspectively seen from the front surface of the head substrate 293 in plane. In the figures, a main scan direction MD, a sub scan direction SD, the elongated direction LGD of the line head 29, and a width direction LTD of the line head 29 are shown. In addition, the width direction LTD of the line head 29 is perpendicular to the elongated direction LGD of the line head 29 and parallel to the sub scan direction SD.

The line head 29 has a case 291 that is elongated in the elongated direction LGD (main scan direction MD), and the head substrate 293 and an optical member 295 are disposed inside the case 291. In addition, two light-emitting element groups (a first light-emitting element group EG1 and a second light-emitting element group EG2) are disposed on a rear surface of the head substrate 293. Since first and second light-emitting element groups EG1 and EG2 have the same configuration, the components of the first light-emitting element group EG1 are mainly described. The components of the second light-emitting element group EG2 are denoted by the same reference numerals in the figure, but detailed description thereof is omitted. As shown in FIG. 5, the first light-emitting element group EG1 includes a plurality of light-emitting elements E that are aligned in two rows in a zigzag shape in the main scan direction MD. In other words, the light-emitting elements E are aligned at a main scan pixel pitch Rm in the main scan direction MD, and the two light-emitting elements E (for example, the light-emitting elements E1 and E2) that are aligned at the main scan pixel pitch Rm in the main scan direction MD are configured to be shift from each other by a sub scan pixel pitch Rs in the sub scan direction SD.

Herein, the main scan pixel pitch Rm is a pitch of pixels in the main scan direction MD, and the sub scan pixel pitch Rs is a pitch of pixels in the sub scan direction SD. Any one of the pixel pitches Rm and Rs are defined according to a resolution of a forming image. In addition, in FIG. 5, the positions of the light-emitting elements E are shown by the intersections of two doted lines, and all the main scan pixel pitches Rm and sub scan pixel pitches Rs are shown by using the positions of the corresponding light-emitting elements E as the starting or ending points. In addition, the position of the light-emitting element E can be obtained as a geometric center of a light-emitting plane of the light-emitting element E.

As described above, the first light-emitting element group EG1 and the second light-emitting element group EG2 have the same configuration. In addition, in the embodiment, the first light-emitting element group EG1 and the second light-emitting element group EG2 have a translational symmetry with respect to the main scan direction MD. Accordingly, by translationally shifting the first light-emitting element group EG1 by the distance De in the main scan direction MD, the first light-emitting element group EG1 can be overlapped with the second light-emitting element group EG2. Therefore, two light-emitting elements (for example, the light-emitting elements E1 and E3 or the light-emitting elements E2 and E4) that are overlapped with each other by the translational shifting can expose the same portion of the surface of the photoreceptor drum 21.

Each of the light-emitting element E constituting the first and second light-emitting element groups EG1 and EG2 is constructed with bottom emission type organic EL (Electro-Luminescence) devices and emit lights with the same frequency. In addition, the head substrate 293 is an optical transparent substrate (for example, a glass substrate) that can transmit light from the light-emitting elements E. Accordingly, light from each of the light-emitting elements E transmit the head substrate 293 toward the optical member 295.

The optical member 295 includes two lens arrays (first lens array LA1 and second lens array LA2). Each of the first and second lens arrays LA1 and LA2 is configured by laminating a plurality of refractive index distributed lenses so as to function as an image forming optical system having an erect unit-magnification image forming characteristic. The first lens array LA1 is disposed to face the first light-emitting element group EG1, so that the first lens array LA1 forms an image by using the light from each of the light-emitting elements E of the first light-emitting element group EG1. Accordingly, a first spot group SG1, where a plurality of spots are aligned in the main scan direction MD, is formed. Therefore, the latent image is formed in a portion exposed by the first spot group SG1 in the surface of the photoreceptor drum 21. Similarly, the second lens array LS2 is disposed to face the second light-emitting element group EG2, so that the second lens array LS2 forms an image by using the light from each of the light-emitting elements E of the second light-emitting element group EG2 to form a second spot group SG2. Therefore, the latent image is formed in a portion exposed by the second spot group SG2 in the surface of the photoreceptor drum 21.

In the line head 29 according to the embodiment, the two light-emitting element groups EG1 and EG2 may be aligned in the sub scan direction SD. In addition, one of the light-emitting element groups EG1 and EG2 selectively perform the exposing operation. More specifically, the changeover circuit 220 of the head controller HC shown in FIG. 3 firstly selects the first light-emitting element group EG1, so that the first light-emitting element group EG1 performs the exposing operation (first exposing operation) to form the latent image on the surface of the photoreceptor drum 21 (first latent image forming operation). In addition, at the same time of the exposing operation, the counter CT measures an accumulated light emission time of each of the light-emitting elements E of the line head 29, and a measurement result of the counter CT is stored in the memory MM of each of the light-emitting elements. In addition, in the case where the accumulated light emission time of some light-emitting elements E exceeds a predetermined time during many times of the exposing operation of the first light-emitting element group EG1, the main-body controller MC applies a changeover command for changing over the light-emitting element group to the changeover circuit 220. In addition, the changeover circuit 220 receiving the changeover command performs the changeover from the first light-emitting element group EG1 to the second light-emitting element group EG2 as the light-emitting element group for performing the exposing operation. Therefore, the second light-emitting element group EG2 performs the exposing operation (second exposing operation), so that the latent image is formed on the surface of the photoreceptor drum 21 (second latent image forming operation). In this manner, one of the two light-emitting element groups EG1 and EG2 selectively performs the exposing operation (latent image forming operation), so that the life cycle of the line head 29 can be prolonged. In addition, since the head controller HC is provided to each of the line heads 29 corresponding to the colors, the changeover operations for changing over the light-emitting element groups EG1 and EG2 in the line heads 29 are independently performed.

As described above, in the tandem type image forming apparatus, a plurality of the image forming stations 2Y, 2M, 2C, and 2K may be aligned in the transport direction of the transfer belt 81. In addition, as shown in FIG. 2, the primary transferring positions TR1*y*, TR1*m*, TR1*c*, and TR1*k*, where the image forming stations 2Y, 2M, 2C, and 2K transfer the toner images on the transfer belt 81, are different from each other. Therefore, in order to superimpose the toner images formed by the image forming stations 2Y, 2M, 2C, and 2K at the same position on the transfer belt 81, the timing control circuit 210 (refer to FIG. 3) adjusts the timings of the exposing operations of the line heads 29 according to a distance between the primary transferring positions.

Figure 6:
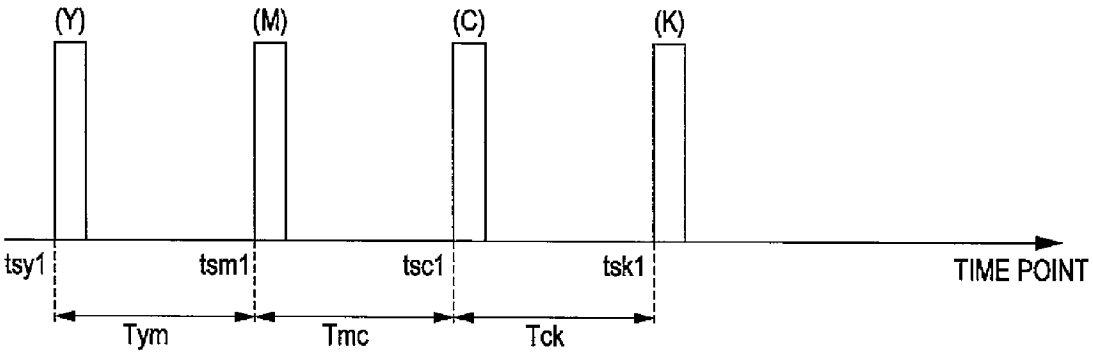
FIG. 6 is a timing chart showing exposing operation starting time points of line heads.

FIG. 6 is a timing chart showing exposing operation starting time points of the line heads. The figure corresponds to the case where all the line heads 29 corresponding to the colors performs the exposing operation by using the first light-emitting element group EG1 to form one-page latent image. As shown in the figure, the yellow (Y) line head 29 starts the exposing operation at the time point tsy1, and the magenta (M) line head 29 starts the exposing operation at the time point tsm1 that is apart by a time difference Tym from the time point tsy. Similarly, the cyan (C) and black (K) line heads 29 starts the exposing operations at the time points tsc1 and tsk1, respectively. In addition, the time differences Tym, Tmc, and Tck between the exposing operation starting time points of the line heads 29 corresponding to the colors are set according to the distances between the primary transferring positions TR1$y$, TR1$m$, TR1$c$, and TR1$k$.For example, the time difference Tym between the exposing operation starting time point tsy of the yellow (Y) line head 29 and the exposing operation starting time point tsm of the magenta (M) line head 29 is set so that the following equation is satisfied.

$$Tym=Lym/V81$$

Herein, the speed V81 is the movement speed of the transfer belt 81. In addition, the other time differences Tmc and Tck are also set in the same manner. In other words, the timing control circuit 210 according to the embodiment controls the exposing operation starting time points tsy1, tsm1, tsc1, and tsk1 of the line heads 29 corresponding to the colors so that the obtained time differences Tym, Tmc, and Tck can be satisfied.

Figure 7:
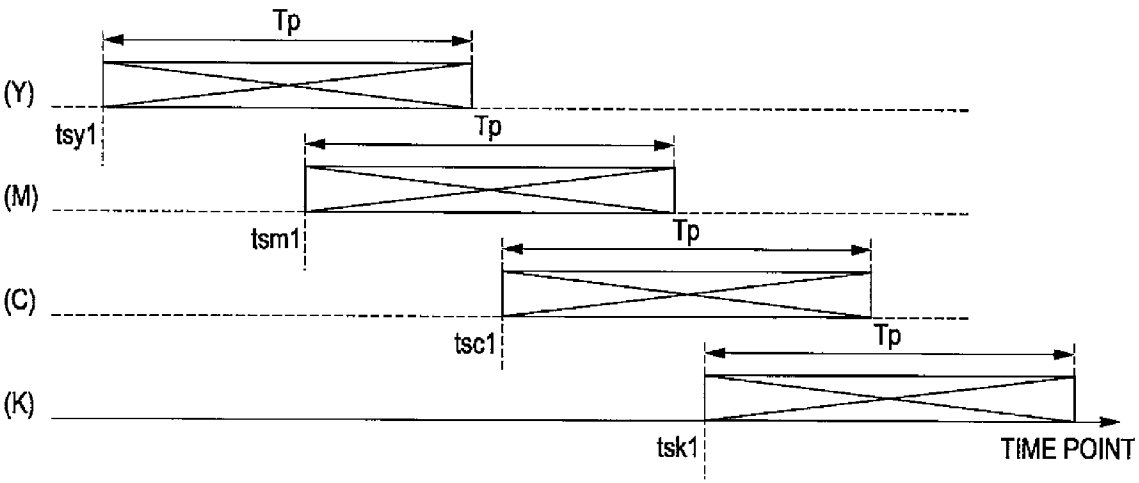
FIG. 7 is a timing chart showing an exposing operation for forming a one-page latent image.

Therefore, in each of the line heads 29, the light-emitting elements of the first light-emitting element group EG1 sequentially emit light in a predetermined time Tp from each of the exposing operation starting time points. Therefore, one-page latent images corresponding to the colors (Y), (M), (C), and (K) are formed (refer to FIG. 7). Herein, FIG. 7 is a timing chart showing an exposing operation for forming a one-page latent image by the line head corresponding to each of the colors. In addition, the one-page latent images corresponding to the colors (Y), (M), (C), and (K) are developed as toner images corresponding to the colors, and the one-page toner images corresponding to the colors are superimposed on the transfer belt 81, so that a one-page color image is completely formed. In this manner, in the embodiment, by adjusting the timings of the exposing operations of the line heads 29 corresponding to the colors (Y), (M), (C), and (K), the toner images formed by the image forming stations 2Y, 2M, 2C, and 2K can be superimposed at the same position on the transfer belt 81.

Since the first light-emitting element group EG1 and the second light-emitting element group EG2 are disposed at the different positions in the sub scan direction SD, these light-emitting element groups EG1 and EG2 form the spot groups SG1 and SG2 at different positions in the sub scan direction SD (refer to FIG. 4). Accordingly, before and after the changeovers of the light-emitting element groups, the forming position of the spot group is changed. Accordingly, before and after the changeovers of the light-emitting element groups, the latent image forming positions on the surface of the photoreceptor drum 21 may be shifted in the sub scan direction SD. Therefore, in the embodiment, in the case where the light-emitting element group is completely replaced, the timing control circuit 210 changes the timing of the exposing operation of the light-emitting element group.

Figure 8:
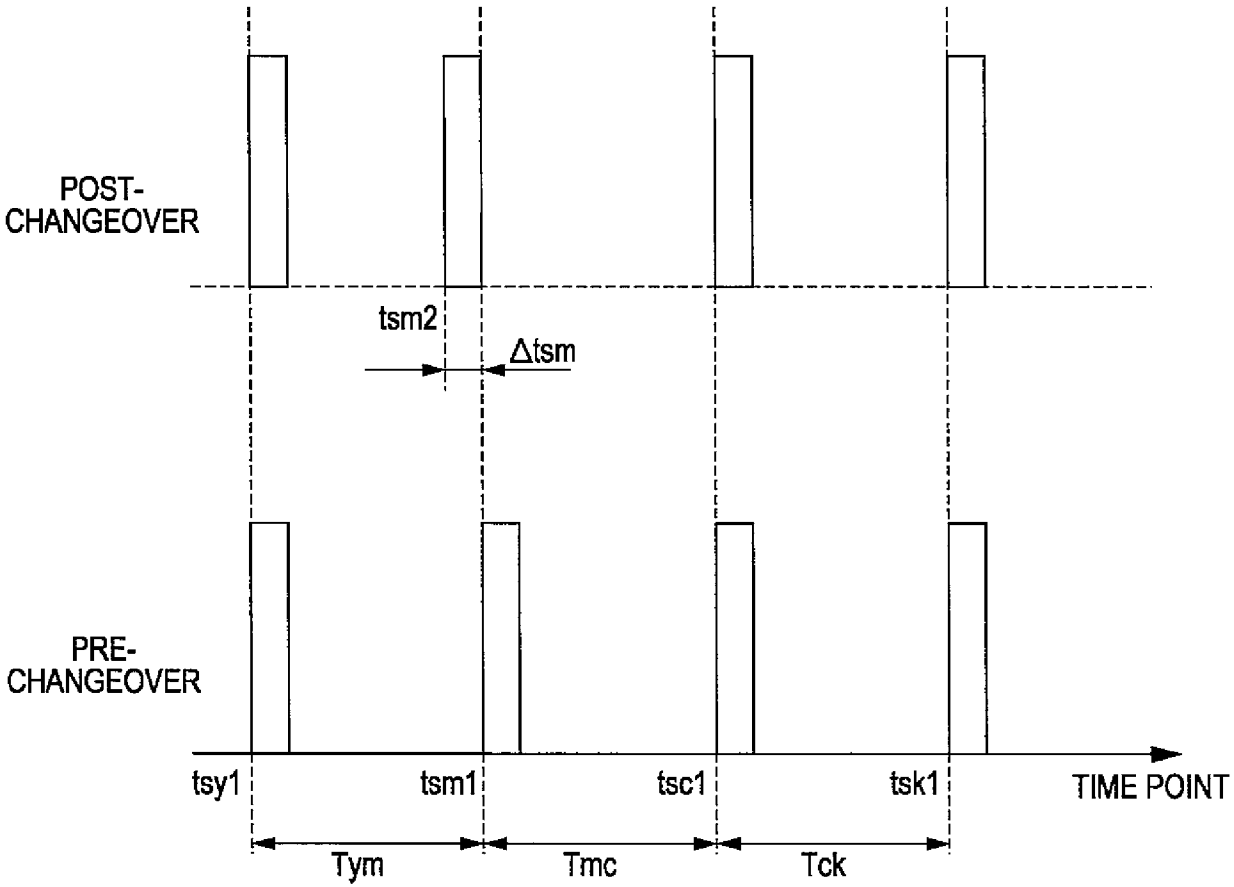
FIG. 8 is a timing chart showing exposing operation starting time points before and after the changeover of light-emitting element groups.

FIG. 8 is a timing chart showing exposing operation starting time points before and after the changeover of light-emitting element groups. The chart of the "pre-changeover" in the figure corresponds to the case where all the line heads 29 corresponding to the colors perform the exposing operations by using the first light-emitting element group EG1. In addition, the chart of the "post-changeover" in the figure corresponds to the case where the light-emitting element group of performing the exposing operation in the magenta (M) line head 29 is changed over to the second light-emitting element group EG2. In addition, in the operation in the chart of the "post-changeover" in the figure, the line heads 29 except for the magenta (M) line head 29 perform the exposing operations by using the first light-emitting element group EG1. In other words, between the chart of the "pre-changeover" and the chart of the "post-changeover", the light-emitting element group of the magenta (M) line head 29 is changed over.

In the "pre-changeover", the line heads start the exposing operations at the time points tsy1, tsm1, tsc1, and tsk1 shown in FIG. 6. On the other hand, in the "post-changeover", the exposing operation starting time point of the magenta (M) line head 29 is changed according to the changeover to the second light-emitting element group EG2 as the light-emitting element group of performing the exposing operation in the magenta (M) line head 29. More specifically, the exposing operation starting time point is shifted to the time point tsm2 that precedes by a time Δtsm from the time point tsm1. The shifted time Δtsm is set according to the distance L21 (the distance L21 in the surface of the photoreceptor drum 21 (refer to FIG. 4)) in the sub scan direction SD between the exposed position (the forming position of the first spot group SG1) of the first light-emitting element group EG1 and the exposed position (the forming position of the second spot group SG2) of the second light-emitting element group EG2. For example, the shifted time Δtsm can be set based on the following equation.

$$\Delta tsm=L21/V21$$

In addition, the distance L21 and the speed V21 are preferably obtained at the time of shipment from factory to be stored in the memory.

Figure 9:
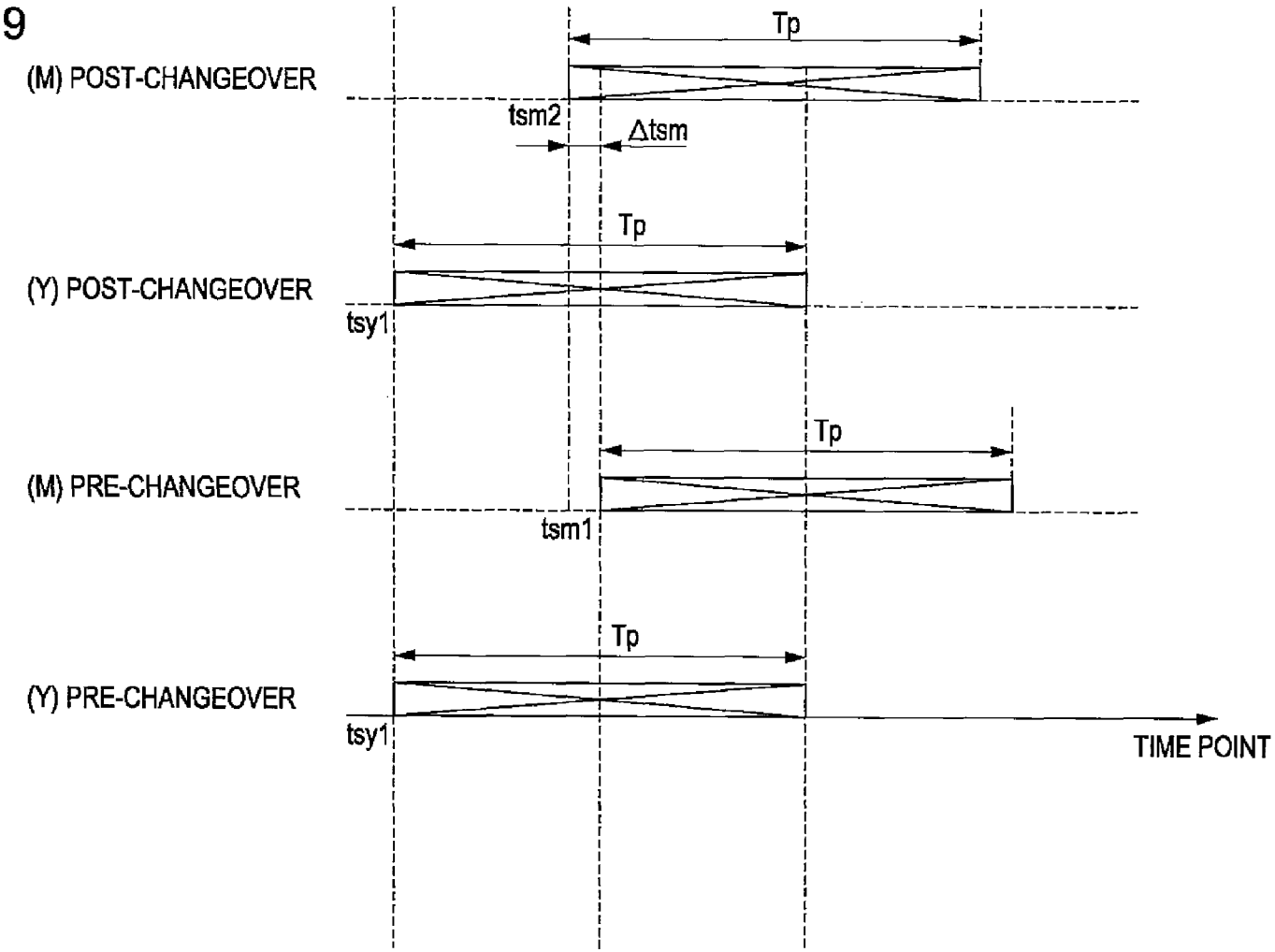
FIG. 9 is a timing chart showing an exposing operation for forming a one-page latent image.

In the magenta (M) line head 29, the second light-emitting element group EG2 sequentially emits light in the time Tp from the time point tsm2 after the changeover (refer to FIG. 9). Herein, FIG. 9 is a timing chart showing the exposing operation for forming a one-page latent image by the magenta line head. In FIG. 9, the exposing operations of the magenta (M) and yellow (Y) line heads 29 are shown. The chart of the "(Y) before the changeover" shows the exposing operation of the yellow (Y) line head before the light-emitting element group of the magenta (M) line head is completely changed over. The chart of the "(M) before the changeover" shows the exposing operation of the magenta (M) line head before the light-emitting element group of the magenta (M) line head is completely changed over. The chart of the "(Y) after the changeover" shows the exposing operation of the yellow (Y) line head after the light-emitting element group of the magenta (M) line head is completely changed over. The chart of the "(M) after the changeover" shows the exposing operation of the magenta (M) line head after the light-emitting element group of the magenta (M) line head is completely changed over.

As shown in FIG. 9, the light emission timing of the light-emitting element group used for the exposing operation is shifted by Δtsm according to the changeover of the light-emitting element group used for the exposing operation of the magenta (M) line head 29. As a result, the shift in the latent image forming position on the surface of the photoreceptor drum 21 corresponding to the magenta (M) is prevented. In addition, the toner images obtained by developing the formed latent image corresponding to the magenta (M) and the formed latent images corresponding to the yellow (Y) and other colors can be accurately superimposed on the surface of the transfer belt 81, so that a good color image can be formed.

As described above, in the embodiment, the light emission timing of the first light-emitting element group EG1 in the first latent image forming operation and the light emission timing of the second light-emitting element group EG2 in the second latent image forming operation are configured to be different from each other. Accordingly, the shift in the latent image forming position is suppressed, so that a good latent image can be formed.

Particularly, in the aforementioned tandem type image forming apparatus, the light emission timing of the first light-emitting element group EG1 in the first latent image forming operation and the light emission timing of the second light-emitting element group EG2 in the second latent image forming operation are preferably configured to be different from each other. The reason is as follows. As described with reference to FIGS. 2, 6, and 7, in order to form a good color image by the tandem type image forming apparatus, it is important to accurately superimpose the toner images corresponding to the colors on the surface of the transfer belt 81. However, with respect to one of the colors, if the shift in the forming position of the latent image corresponding to the corresponding one color occurs due to the changeover from the first latent image forming operation to the second latent image forming operation, the toner images corresponding to the colors are not accurately superimposed on the surface of the transfer belt 81, so that the deviation in color occurs in the formed color image. On the contrary, in the embodiment, the light emission timing of the first light-emitting element group EG1 in the first latent image forming operation and the light emission timing of the second light-emitting element group EG2 in the second latent image forming operation are configured to be different from each other. Therefore, the shift in the latent image forming position before and after the changeover from the first latent image forming operation to the second latent image forming operation is suppressed, so that a good color image without the deviation in color can be obtained.

In addition, as described above, the shift in the latent image forming position is caused from a difference between the position of the spot formed by the light-emitting element E of the first light-emitting element group EG1 and the position of the spot formed by the light-emitting element E of the second light-emitting element group EG2. Therefore, in the embodiment, the light emission timing of the first light-emitting element group EG1 in the first latent image forming operation and the light emission timing of the second light-emitting element group EG2 in the second latent image forming operation are configured to be different from each other according to the distance L21 (refer to FIG. 4) between the spot formed by the light-emitting element E of the first light-emitting element group EG1 and the spot formed by the light-emitting element E of the second light-emitting element group EG2. Therefore, the shift in the latent image forming position is accurately suppressed, so that a better latent image can be formed.

In addition, the latent image forming position on the surface of the photoreceptor drum 21 also influences the movement speed of the surface of the photoreceptor drum 21. Therefore, in the embodiment, the second light emission timing is configured to be different from the first light emission timing according to the movement speed V21 of the surface of the photoreceptor drum 21. Therefore, the shift in the latent image forming position is accurately suppressed, so that a better latent image can be formed.

In addition, in the embodiment, the first light-emitting element group EG1 and the second light-emitting element group EG2 have a translational symmetry with respect to the main scan direction MD. As a result, the light emission timing control can be simplified. The reason is described as follow by exemplifying the light-emitting elements E1, E2, E3, and E4 shown in FIG. 5.

As described above, according to the changeover of the light-emitting element groups EG1 and EG2, the light-emitting element E3 is changed to the light-emitting element E1 to expose the portion, which is exposed by the light-emitting element E1, and the light-emitting element E4 is changed to the light-emitting element E2 to expose the portion, which is exposed by the light-emitting element E2. In addition, in order to suppress the shift in the latent image forming position, the light emission timing of the light-emitting element E3 is configured to be delayed from the light emission timing of the light-emitting element E1 by a time corresponding to the distance (inter-spot distance) between the spot formed by the light-emitting element E3 and the spot formed by the light-emitting element E1. In addition, similarly, the light emission timing of the light-emitting element E4 is configured to be delayed from the light emission timing of the light-emitting element E2 by a time corresponding to the distance (inter-spot distance) between the spot formed by the light-emitting element E4 and the spot formed by the light-emitting element E2. Herein, since the light-emitting element groups EG1 and EG2 have a translational symmetry with respect to the sub scan direction SD, the distance between the light-emitting element E1 and the light-emitting element E3 and the distance between the light-emitting element E2 and the light-emitting element E4 are equal to the distance De. Accordingly, the distance between the spot formed by the light-emitting element E3 and the spot formed by the light-emitting element E1 is equal to the distance between the spot formed by the light-emitting element E4 and the spot formed by the light-emitting element E2. Accordingly, the shifted time of the light emission timing of the light-emitting element E3 with respect to the light emission timing of the light-emitting element E1 and the shifted time of the light emission timing of the light-emitting element E4 with respect to the light emission timing of the light-emitting element E2 may be configured to be equal to the same time (time Δtsm in the embodiment). In this manner, in the embodiment, the shifted time of the light emission timing before and after the changeover of the light-emitting element groups EG1 and EG2 can be commonly used for the light-emitting elements E, so that the light emission timing control can be simplified. In addition, the configuration of the timing control circuit 210 for performing the light emission timing control can also be simplified.

In addition, in the embodiment, the counter CT that measures the accumulated light emission time of each of the light-emitting elements E of the first light-emitting element group EG1 is included, so that the changeover from the first latent image forming operation to the second latent image forming operation can be performed based on a measurement result of the counter CT. Accordingly, when the light-emitting element E of the first light-emitting element group EG1 is exhausted, the changeover from the first latent image forming operation to the second latent image forming operation can be securely performed.

In this manner, in the embodiment, the line head 29 functions as the "exposure head" according to the invention. In addition, each of the light-emitting elements E of the first light-emitting element group EG1 corresponds to the "first light-emitting element" according to the invention, and each of the light-emitting elements E of the second light-emitting element group EG2 corresponds to the "second light-emitting element" according to the invention. In addition, the main-body controller MC and the head controller HC cooperate to function as the "control unit" according to the invention, and the counter CT functions as the "light emission time measuring unit" according to the invention. In addition, the time Δtsm corresponds to the "first time" according to the invention. In addition, the time point tsm1 corresponds to the "first light emission timing" according to the invention, and the time point tsm2 corresponds to the "second light emission timing" according to the invention.

In addition, the invention is not limited to the aforementioned embodiments, but various modifications can be made without departing from the spirit of the invention. For example, in the aforementioned embodiments, the changeover from the first latent image forming operation using the first light-emitting element group EG1 to the second latent image forming operation using the second light-emitting element group EG2 is performed based on the accumulated light emission time of the light-emitting element E. However, the operation of changing over the light-emitting element groups EG1 and EG2 is not limited thereto. Accordingly, the counter CT may be configured to function as a latent image sheet number measuring unit that measure the sheet number of the latent images formed by the first latent image forming operation, and the changeover from the first latent image forming operation to the second latent image forming operation may performed based on a measurement result of the latent image sheet number measuring unit, that is, the counter CT. According to the configuration, when the light-emitting element E is exhausted, the changeover from the first latent image forming operation to the second latent image forming operation is securely performed.

In addition, the sheet number of the recording medium transported by the feeding unit 7 (transporting unit) may be measured by the counter CT (sheet number measuring unit), and the sheet number of the recording medium, to which the latent image formed by the first exposing operation is transferred, may be calculated based on a measurement result of the counter CT, so that the changeover from the first exposing operation to the second exposing operation is performed based on a result of the calculation. According to the configuration, when the light-emitting element is exhausted, the changeover from the first exposing operation to the second exposing operation can be securely performed.

In addition, in the embodiment, the changeover is performed from the first latent image forming operation of the first light-emitting element group EG1 to the second latent image forming operation of the second light-emitting element group EG2. However, the changeover order of the latent image forming operation is not limited thereto. Accordingly, the changeover may be performed from the second latent image forming operation of the second light-emitting element group EG2 to the first latent image forming operation of the first light-emitting element group EG1. In addition, the changeover may be configured by user's checking the formed image.

In the aforementioned embodiments, the shifted time Δtsm is set based the following equation.

$$\Delta tsm = L21/V21$$

However, the method of setting the shifted time Δtsm is not limited thereto. In other words, as described above, in a tandem type image forming apparatus, a shift in the latent image forming position before and after the changeover of the light-emitting element groups EG1 and EG2 leads to a deviation in color of a color image. Therefore, while the shifted time Δtsm is changed stepwise, register marks are formed on the transfer belt 81. A degree of deviation in color is obtained from a result of detection of the register marks that are detected by a sensor 89, and the shifted time Δtsm may be set based on the result of detection.

In addition, in the aforementioned embodiments, in the light-emitting element groups EG1 and EG2, a plurality of the light-emitting elements E are aligned in two rows in a zigzag shape. However, a plurality of the light-emitting elements E may be aligned in three or more rows in a zigzag shape. In addition, a plurality of the light-emitting elements E may be aligned in other manners.

In addition, in the embodiment, the light-emitting elements E are constructed with bottom emission type organic EL devices. However, the light-emitting elements E may be constructed with top emission type organic EL devices or LEDs (Light Emitting Diodes).

The entire disclosure of Japanese Patent Applications No. 2009-019672, filed on Jan. 30, 2009 is expressly incorporated by reference herein.

What is claimed is:

1. An image forming apparatus comprising:

a latent image carrier, on which a latent image is formed;

an exposure head that includes a first light-emitting element and a second light-emitting element that is disposed in a direction in which the latent image carrier corresponding to the first light-emitting element is moved;

a control unit that changes over and performs a first latent image forming operation, in which the latent image is formed on the latent image carrier by using the first light-emitting element, and a second latent image forming operation, in which the latent image is formed on the latent image carrier by using the second light-emitting element;

a developing unit that develops the latent image formed on the latent image carrier;

a transferring unit that transfers the image developed by the developing unit to a recording medium;

a transporting unit that transports the recording medium; and a sheet number measuring unit that measures a sheet number of recording medium transported by the transporting unit, wherein the control unit controls a first light emission timing of the first light-emitting element in the first latent image forming operation and a second light emission timing of the second light-emitting element in the second latent image forming operation to be different from each other, and the control unit calculates the sheet number of the recording medium, to which the developed image of the latent image formed by the first latent image forming operation is transferred, based on a measurement result of the sheet number measuring unit and performs the changeover from the first latent image forming operation to the second latent image forming operation based on the calculated sheet number.

2. The image forming apparatus according to claim 1, wherein the control unit controls the second light emission timing to be different from the first light emission timing according to a distance between a latent image spot formed by the first light-emitting element and a latent image spot formed by the second light-emitting element.

3. The image forming apparatus according to claim 2, wherein the control unit controls the second light emission timing to be different from the first light emission timing according to a movement speed of the latent image carrier.

4. The image forming apparatus according to claim 1, further comprising a light emission time measuring unit that measures an accumulated light emission time of the first light-emitting element, wherein the control unit performs changeover from the first latent image forming operation to the second latent image forming operation based on a measurement result of the light emission time measuring unit.

* * * * *